US008225871B2

(12) United States Patent
Beall et al.

(10) Patent No.: US 8,225,871 B2
(45) Date of Patent: Jul. 24, 2012

(54) BIDIRECTIONAL SEALING MECHANICALLY SHIFTED BALL VALVE FOR DOWNHOLE USE

(75) Inventors: Clifford H. Beall, Broken Arrow, OK (US); James T. Sloan, Broken Arrow, OK (US); Richard Patterson, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 594 days.

(21) Appl. No.: 12/359,786

(22) Filed: Jan. 26, 2009

(65) Prior Publication Data

US 2009/0184278 A1 Jul. 23, 2009

Related U.S. Application Data

(63) Continuation-in-part of application No. 11/595,596, filed on Nov. 9, 2006, now Pat. No. 7,810,571.

(51) Int. Cl.
*E21B 34/12* (2006.01)

(52) U.S. Cl. ..... 166/332.3; 166/334.2

(58) Field of Classification Search ..... 166/332.3, 166/334.2, 332.7
See application file for complete search history.

(56) References Cited

U.S. PATENT DOCUMENTS 3,346,937 A 10/1967 Folkerts
3,868,995 A * 3/1975 Crowe ..... 166/324
3,886,967 A 6/1975 Nelson
3,971,438 A 7/1976 Crowe
RE29,471 E * 11/1977 Giroux ..... 166/334.2
4,103,744 A 8/1978 Akkerman
4,130,166 A 12/1978 Akkerman et al.
4,197,879 A 4/1980 Young
4,289,165 A 9/1981 Fredd
4,293,038 A 10/1981 Evans
4,325,434 A 4/1982 Roberts
4,332,267 A 6/1982 Evans
4,368,871 A 1/1983 Young
4,406,328 A 9/1983 Brooks
4,415,037 A 11/1983 Brooks
4,446,922 A 5/1984 Bowyer et al.
4,449,587 A 5/1984 Rodenberger et al.
4,467,870 A 8/1984 Langham
4,475,598 A 10/1984 Brakhage, Jr. et al.
4,476,933 A 10/1984 Brooks
4,519,576 A 5/1985 Winegeart
(Continued)

OTHER PUBLICATIONS

Brown, Irvine, "A Successful Completion/Perforation by Use of a Downhole Lubricator Vavle: A Case Study from the Siri Filed, Danish Sector, North Sea", SPE 63113, Oct. 2000, 1-7.

(Continued)

*Primary Examiner* — William P Neuder
(74) *Attorney, Agent, or Firm* — Steve Rosenblatt

(57) ABSTRACT

A downhole ball valve is mounted n a string and features a rotating ball that turns on its axis as it is held against an upstream and a downstream seal by a cage. The cage accepts a slide that engages the ball off-center to rotate it between the open and closed positions. The slide is operated by a sleeve attached to a piston assembly. The sleeve is mechanically operated in opposed directions such as by a wireline shifting tool. Differential pressure on a closed ball does not affect the actuation piston because pressure across the actuating piston is balanced while holding pressure differential across the closed ball. A check valve allows the actuation piston to be in pressure balance as the ball stays closed.

14 Claims, 5 Drawing Sheets

U.S. PATENT DOCUMENTS

| | | | | | |
|---|---|---|---|---|---|
| 4,522,370 | A | | 6/1985 | Noack et al. | |
| 4,560,004 | A | * | 12/1985 | Winslow et al. | 166/321 |
| 4,569,397 | A | | 2/1986 | Brakhage, Jr. et al. | |
| 4,627,492 | A | | 12/1986 | MacLaughlin | |
| 4,651,829 | A | * | 3/1987 | Hushbeck et al. | 166/321 |
| 5,417,405 | A | | 5/1995 | Stephan et al. | |
| 5,564,675 | A | | 10/1996 | Hill et al. | |
| 5,865,246 | A | | 2/1999 | Brown | |
| 6,109,352 | A | | 8/2000 | Edwards et al. | |
| 6,223,824 | B1 | | 5/2001 | Moyes | |
| 6,691,785 | B2 | | 2/2004 | Patel | |
| 6,695,286 | B1 | | 2/2004 | Florio et al. | |
| 6,708,946 | B1 | | 3/2004 | Edwards et al. | |
| 2001/0045285 | A1 | | 11/2001 | Russell | |
| 2002/0040788 | A1 | | 4/2002 | Hill, Jr. et al. | |
| 2006/0272825 | A1 | | 12/2006 | Royer | |
| 2008/0223581 | A1 | | 9/2008 | Beall et al. | |

OTHER PUBLICATIONS

Heijnen, W.H.P.M., et al., "Subsurface Safety Valve Developments for Gaswells", SPE 19283-1, Sep. 1989, 6 pages.

* cited by examiner

BIDIRECTIONAL SEALING MECHANICALLY SHIFTED BALL VALVE FOR DOWNHOLE USE

PRIORITY INFORMATION

This application is a continuation in part of application Ser. No. 11/595,596 filed Nov. 9, 2006 entitled Downhole Lubricator Valve.

FIELD OF THE INVENTION

The field of the invention relates to downhole shutoff valves, that can be used in a lubricator application, that allow a string to be made up in a live well by isolation of a lower portion of it and more particularly to features regarding such valves relating to mechanically operating them and design features that prevent applied differential pressure from above to inadvertently open them.

BACKGROUND OF THE INVENTION

Lubricator valves are valves used downhole to allow long assemblies to be put together in the well above the closed lubricator valve with well pressure further below the closed lubricator valve. These valves are frequently used in tandem with sub-surface safety valves to have redundancy of closures against well pressures below.

Lubricator assemblies are used at the surface of a well and comprise a compartment above the wellhead through which a bottom hole assembly is put together with the bottom valve closing off well pressure. These surface lubricators have limited lengths determined by the scale of the available rig equipment. Downhole lubricators simply get around length limitations of surface lubricators by using a lubricator valve downhole to allow as much as thousands of feet of length in the wellbore to assemble a bottom hole assembly.

In the past ball valves have been used as lubricator valves. They generally featured a pair of control lines to opposed sides of a piston whose movement back and forth registered with a ball to rotate it 90 between an open and a closed position. Collets could be used to hold the ball in both positions and would release in response to control pressure in one of the control lines. An example of such a design can be seen in U.S. Pat. Nos. 4,368,871; 4,197,879 and 4,130,166. In these patents, the ball turns on its own axis on trunnions. Other designs translate the ball while rotating it 90 degrees between and open and a closed position. One example of this is the 15K Enhanced Landing String Assembly offered by the Expro Group that includes such a lubricator valve. Other designs combine rotation and translation of the ball with a separate locking sleeve that is hydraulically driven to lock the ball turning and shifting sleeve in a ball closed position as shown in U.S. Pat. No. 4,522,370. Some valves are of a tubing retrievable style such as Halliburton's PES® LV4 Lubricator Valve. Lock open sleeves that go through a ball have been proposed in U.S. Pat. No. 4,449,587. Other designs, such as U.S. Pat. No. 6,109,352 used in subsea trees have a rack and pinion drive for a ball and use a remotely operated vehicle (ROV) to power the valve between open and closed positions claiming that either end positioned is a locked position but going on to state that the same ROV simply reverses direction and the valve can reverse direction. Ball valves that are not used downhole are shown in U.S. Pat. Nos. 6,695,286; 4,289165 and 5,417,405.

What is lacking and addressed by the present invention is a more elegant solution to a downhole ball type valve for use in applications such as a barrier or in a sand control application, for a few examples. The present invention is directed to a mechanical actuation of a ball valve through a shifting of a sleeve that can in one instance be actuated with a shifting tool run on wireline. It further provides a pressure equalizing mechanism on the actuation assembly in the event the ball is closed and pressure differential comes from above the ball. The pressure is equalized on the actuation mechanism but not across the closed ball so as to prevent pressure differential from moving a sleeve in the actuation mechanism that would otherwise rotate the ball open. These and other features of the present invention will become more readily apparent to those of ordinary skill in the art from a review of the description of the preferred embodiment that appears below in conjunction with the associated drawings while recognizing that the appended claims are the full measure of the invention.

SUMMARY OF THE INVENTION

A downhole ball valve is mounted n a string and features a rotating ball that turns on its axis as it is held against an upstream and a downstream seal by a cage. The cage accepts a slide that engages the ball off-center to rotate it between the open and closed positions. A sleeve is attached to a piston assembly which in turn is attached to the slide for tandem movement to rotate a ball. The sleeve is mechanically operated in opposed directions such as by a wireline shifting tool. Differential pressure on a closed ball does not affect the actuation piston because pressure across the actuating piston is balanced while holding pressure differential across the closed ball. A check valve allows the actuation piston to be in pressure balance as the ball stays closed.

DETAILED DESCRIPTION OF THE PREFERRED EMBODIMENT

Figure 1:
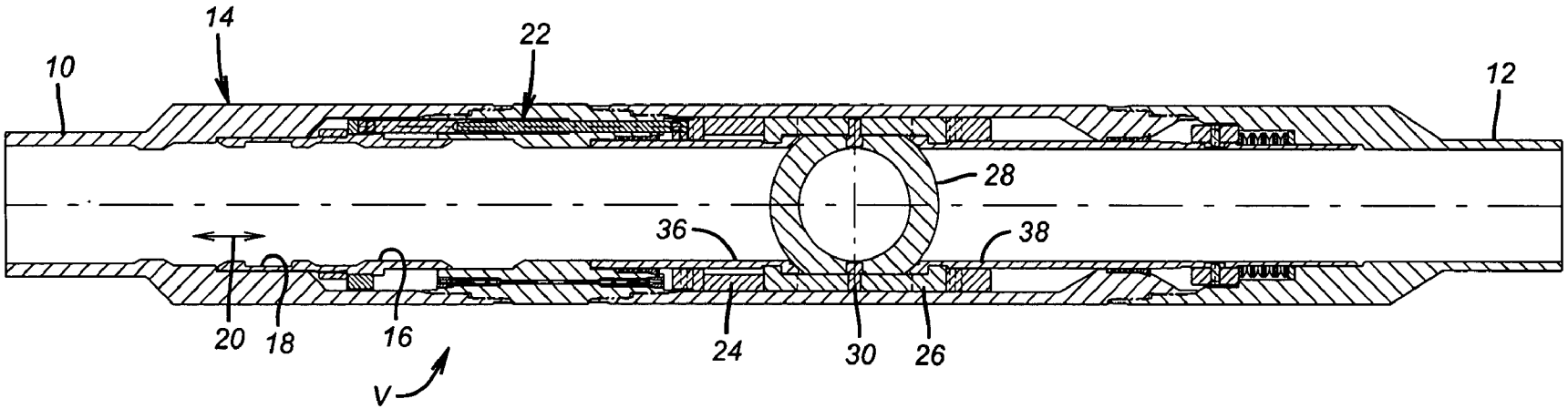
FIG. 1 is a section view of the entire valve assembly.
Figure 5:
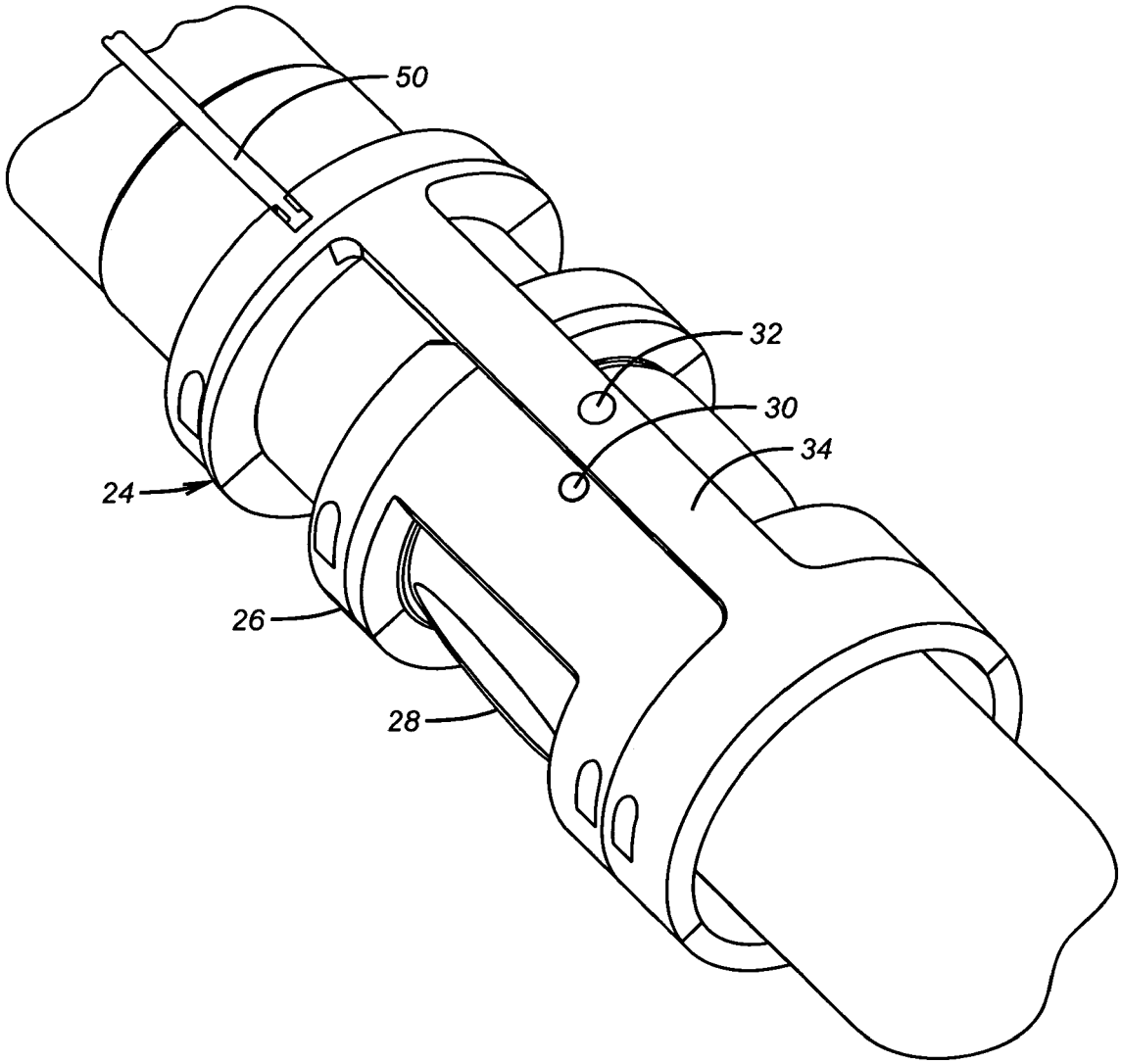
FIG. 5 is a perspective to show the interaction of the slide with the cage in the operation of the ball.

Referring to FIGS. 1 and 5, the valve V is part of a string (not shown) that goes downhole and is connected to the top end 10 and the bottom end 12 of the housing 14. An inner sleeve 16 has an internal groove 18 to be engaged and moved in opposed directions preferably by a wireline tool represented schematically by double headed arrow 20. Movement of sleeve 16 shifts the piston assembly 22 and with it slide 24 relative to stationary cage 26. Ball 28 is pinned with opposed pins 30 so that it can rotate about them on its central axis. Pins 32 extend from arms 34 and engage ball 28 off-center so as to be able to rotate ball 28 in opposed directions when the slide 24 moves with respect to the stationary cage 26. Upper seat 36 and lower seat 34 are retained to the ball 28 with the cage 26.

Figure 2:
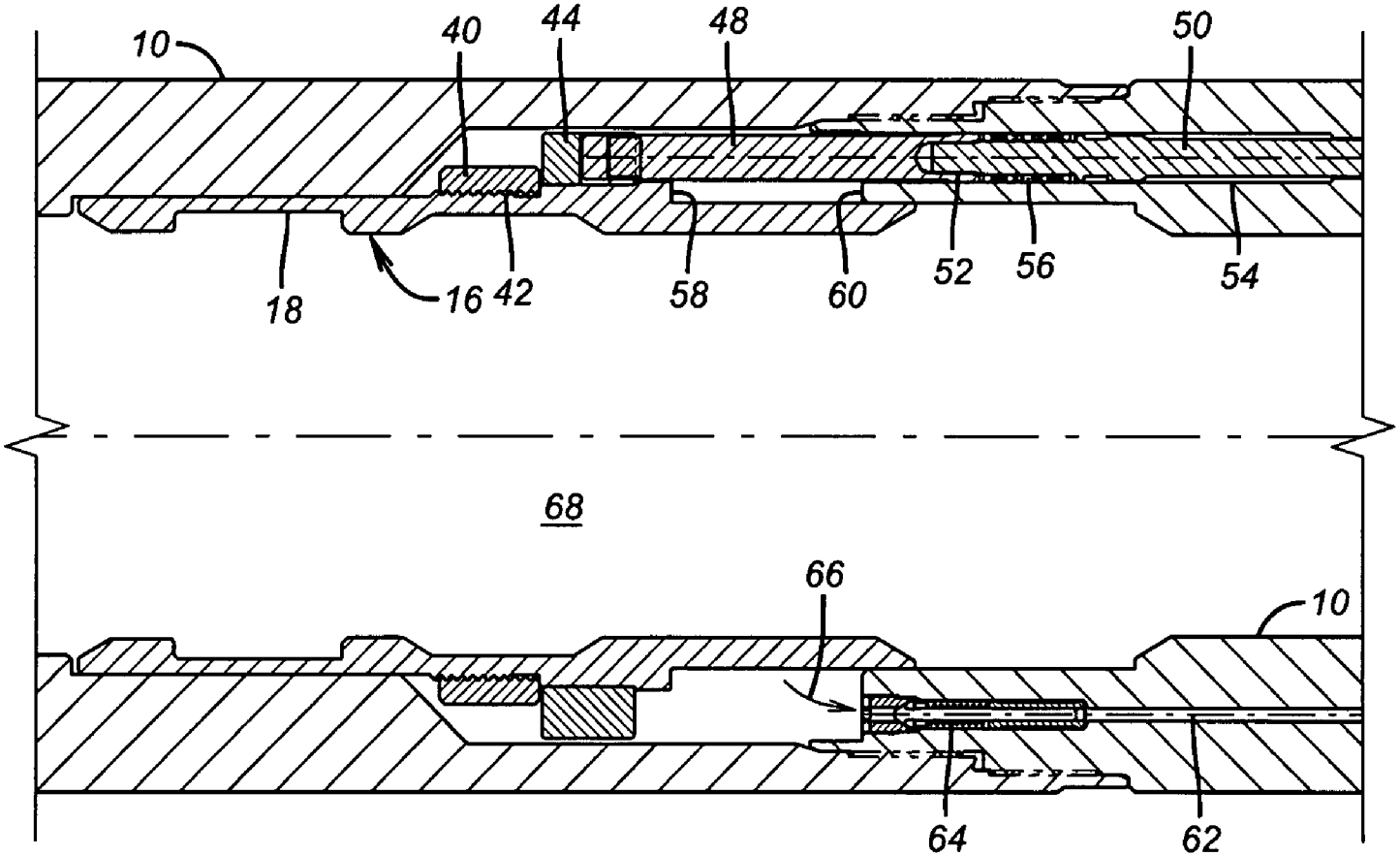
FIG. 2 is an enlarged view of the top of the assembly in FIG. 1.
Figure 3:
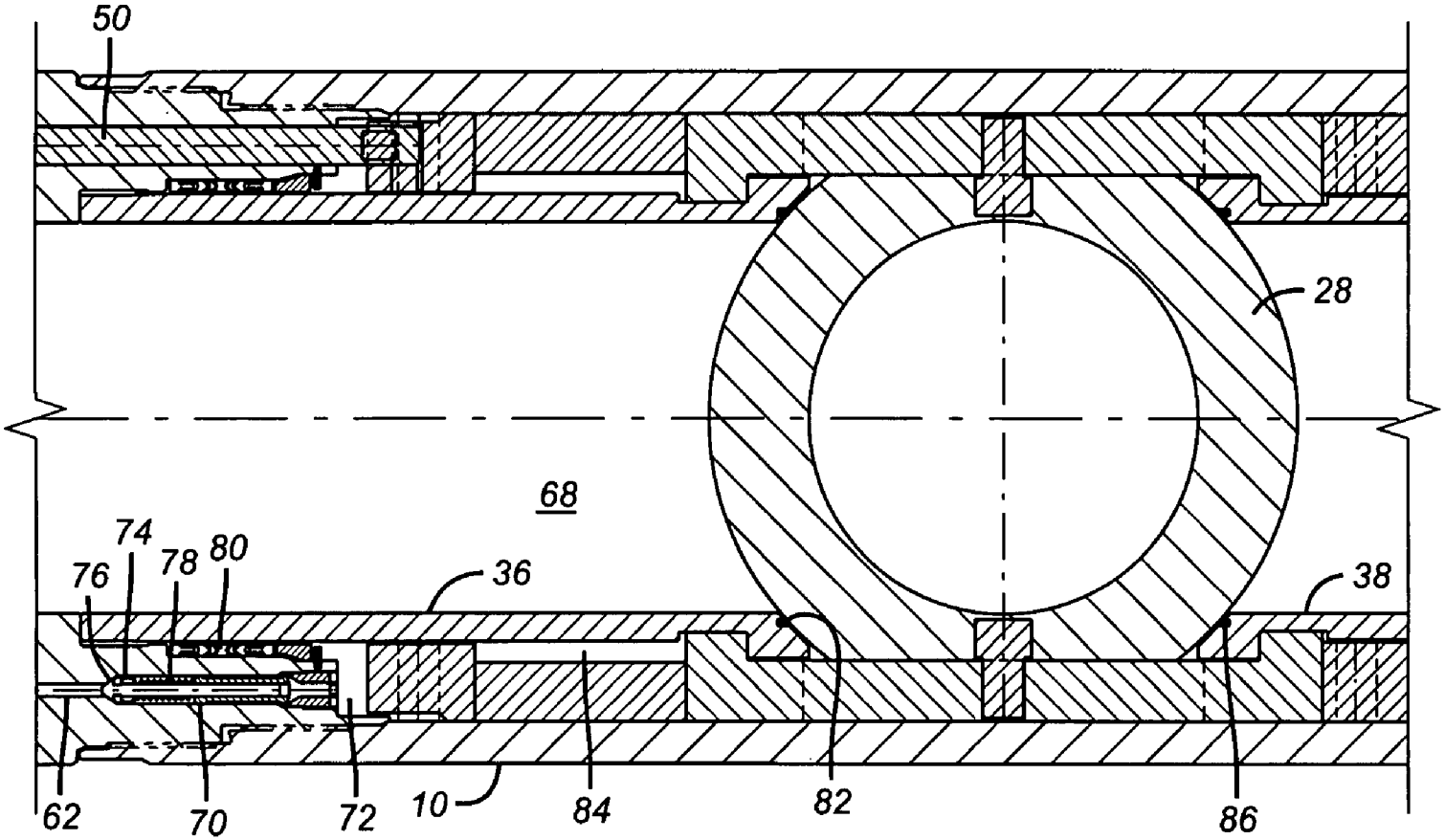
FIG. 3 is an enlarged view of the middle of the assembly of FIG. 1.
Figure 4:
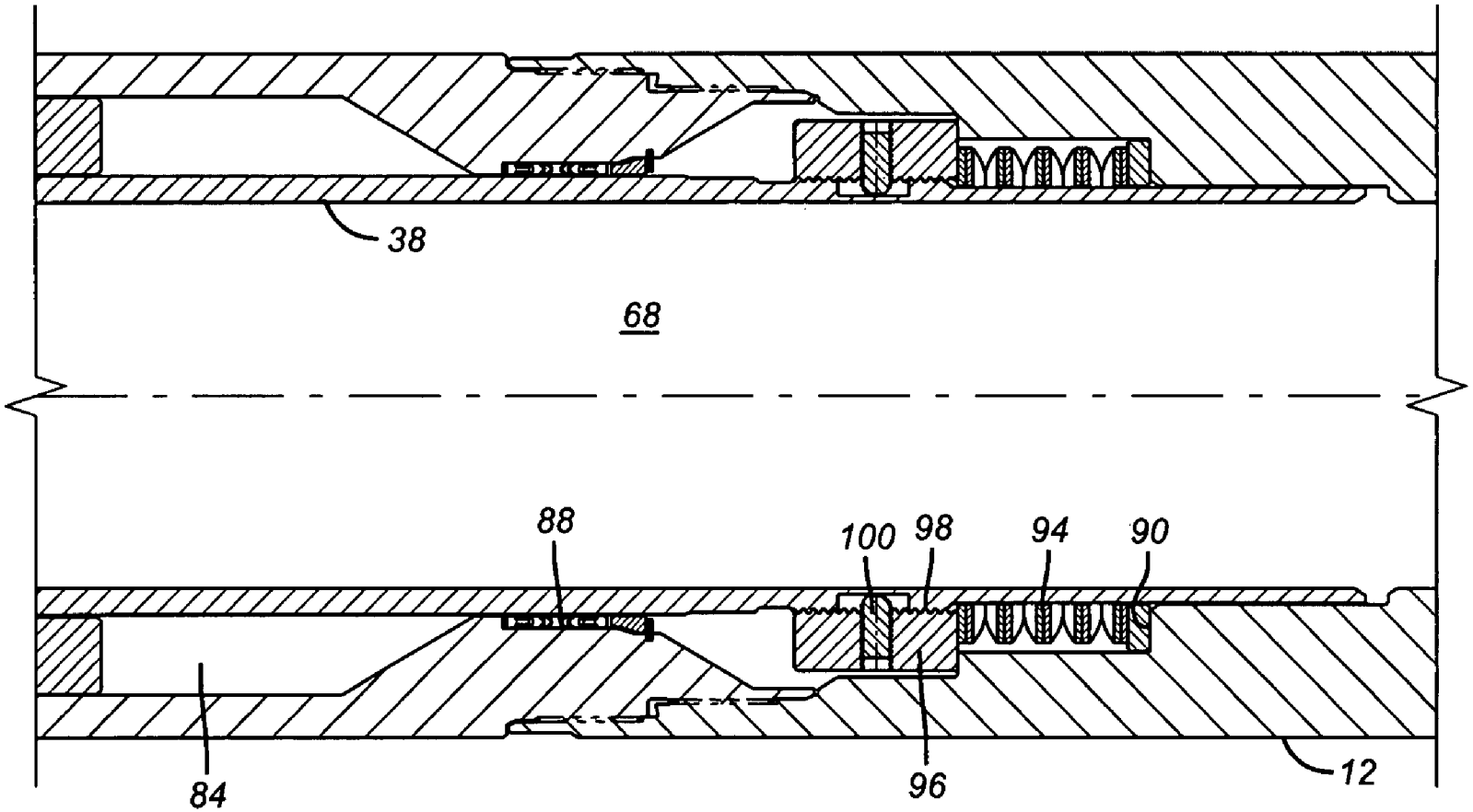
FIG. 4 is an enlarged view of the lower end of the assembly in FIG. 1.

With the major components now described, a detailed description of the remaining components will be more readily understood using the enlarged views of FIGS. 2-4. Sleeve 16 has a retaining nut 40 held to it externally at thread 42. Nut 40 bears down on piston connector 44 for downward tandem movement. During upward movement of sleeve 16 a shoulder 46 engages the piston connector 44 for tandem movement. Connector 44 is attached to upper piston 48, which is in turn attached to a lower piston 50 at thread 52. Lower piston 50 moves in a bore 54 in housing 10 and is sealed in bore 54 with seals 56. As seen in FIG. 5, the lower end of lower piston 50 is attached to slide 24 so that pins 32 can be shifted relative to pins 30 that fix the ball 28 to the cage 26 to allow ball 28 to be rotated about pins 30 between an open and a closed position that represent preferably 90 degree rotation of ball 28. One way to limit the downward movement of sleeve 16 is when shoulder 58 hits shoulder 60 of body 10. While a single piston assembly 22 has been described in detail, those skilled in the art that additional assemblies can be used and are preferably disposed on equal spacing circumferentially in housing 10 so as to minimize any moment that is applied to the slide 24 from motion imparted from a tool moving sleeve 16.

Body 10 has at least one bore 62 with a check valve 64 which allows pressure from above represented by arrow 66 to enter bore 62 with the ball 28 in the closed position. When the ball 28 is in the closed position, passage 68 is obstructed as is bore 54 due to the seals 56 on lower piston 50. Normally, without bore 62 and check valve 64 pressure could build on connector 44 and urge the piston assembly 22 down. This could have an undesirable effect of shifting the piston assembly 22 and ultimately the ball 28 from the closed to the open position. The presence of bore 62 and check valve 64 allows a differential from uphole of a closed ball 28 to avoid putting a net force on the piston assembly 22 by equalizing pressure to it but without equalizing pressure across the closed ball 28. Reference to FIG. 3 further clears up this concept.

FIG. 3 shows a redundant check valve 70 at the lower end of bore 62 and oriented in the same direction as check valve 64 to serve as a backup to it. Preferably they are the same and feature a poppet 74 biased against a seat 76 by a spring 78. Other one way flow device can be used instead. Bore 62 opens into annular space 72 which is also in communication with lower piston 50. In that way, when the flow is past the check valves in bore 62 to the annular space 72 the piston assembly 22 is in pressure balance from pressure in passage 68 above the closed ball 28.

Upper seat 36 has a seal stack 80 against the housing 10 and a ball seal 82 to contact ball 28 that together effectively hold pressure above the closed ball 28 and out of space 84 where the slide 24 and the cage 26 are disposed. In fact spaces 72 and 84 are contiguous. FIG. 3 also shows lower seat assembly 38 with a resilient seal 86 in contact with ball 28. Seat assembly 38 continues into FIG. 4 further showing seal stack 88, which is similar in size and function to seal stack 80. A shoulder 90 on housing 10 supports a ring 92 and a wave spring or Belleville washer stack 94 that push on nut 96 secured at thread 98 to the lower seat assembly 38. Set screw 100 holds the position of nut 96. Stack 94 puts a preload on seals 82 and 86 that are in contact with the ball 28. Seal 88 as with seal 80 help to retain the pressure in passage 68 and isolate spaces 84 and 72 from the pressure in passage 68.

Those skilled in the art will appreciate that the ball valve of the present invention can be used downhole and operated mechanically within the string preferably by a wireline shifting tool to move from the open to the closed position and back. Other shifting tools that are run on coiled or rigid tubing can be used instead. It has an equalization provision to prevent unintended opening of the ball 28 when it is in the closed position by pressure buildup from above the closed ball 28. The equalization occurs on the piston assembly 22 that is above the ball without equalizing pressure across the closed ball. In the closed position, the ball 28 seals against differential pressures in opposed directions using ball seals 82 and 86 that remain in contact with ball 28 regardless of the direction of differential pressure on the closed ball 28. The pressure equalization on the piston assembly 22 is not dependent on any initial ball rotation of ball 28. Wave spring 94 provides a preload to enhance contact between ball 28 and seals 82 and 86 when there is differential from downhole and it resists separation of ball 28 from seal 82 in situations of net differential pressure in a downhole direction.

It is to be understood that this disclosure is merely illustrative of the presently preferred embodiments of the invention and that no limitations are intended other than as described in the appended claims.

We claim:

1. A ball valve for downhole use in a tubular string, comprising:

a housing further comprising a ball in a passage therethough with seals operatively connected to said ball, said ball movable between an open position where said passage is open to flow and a closed position where the passage is closed;

an actuator assembly movably mounted in said passage on one side of said ball and accessible within said passage to be shifted to move said ball between said open and closed positions.

2. The ball valve of claim 1, wherein:

said passage is closed to differential pressure in opposed directions when said ball is in said closed position.

3. A ball valve for downhole use in a tubular string, comprising:

a housing further comprising a ball in a passage therethough with seals operatively connected to said ball, said ball movable between an open position where said passage is open to flow and a closed position where the passage is closed;

an actuator assembly movably mounted in said passage and accessible within said passage to be shifted to move said ball between said open and closed positions;

said actuator assembly, with said ball in said closed position, is selectively in pressure balance with pressure in the portion of said passage in which said actuator assembly is disposed.

4. The ball valve of claim 3, wherein:

said actuator assembly can be put into pressure balance without movement of said ball.

5. The ball valve of claim 4, wherein:

said actuator assembly can be put into pressure balance through a flow equalizer passage comprising at least one one way valve.

6. The ball valve of claim 5, wherein:

said actuator assembly comprises a shifting sleeve operatively connected to said ball.

7. The ball valve of claim 6, wherein:

said actuator assembly comprises at least one piston connected to said sleeve adjacent one end and operably connected to said ball adjacent another end, said piston having at least one seal between said ends that are opposed and said piston movable in a piston bore in said housing, said piston bore comprising a first end that is exposed to pressure in said passage on one side of said ball and a second end sealingly isolated from said pressure in said passage on the same side of said ball.

8. The ball valve of claim 6, wherein:

said shifting sleeve comprises an internal recess accessible from said passage for shifting said sleeve with a tool inserted through the string into said housing.

9. The ball valve of claim 8, further comprising:

a wireline supported shifting tool to engage said internal recess to shift said shifting sleeve in opposed directions.

10. A ball valve for downhole use in a tubular string, comprising:

a housing further comprising a ball in a passage therethough with seals operatively connected to said ball, said ball movable between an open position where said passage is open to flow and a closed position where the passage is closed;

an actuator assembly movably mounted in said passage to move said ball between said open and closed positions;

said actuator assembly, with said ball in said closed position, is selectively in pressure balance with pressure in the portion of said passage in which said actuator assembly is disposed;

said actuator assembly can be put into pressure balance without movement of said ball;

said actuator assembly can be put into pressure balance through a flow equalizer passage comprising at least one one way valve;

said actuator assembly comprises a shifting sleeve operatively connected to said ball;

said actuator assembly comprises at least one piston connected to said sleeve adjacent one end and operably connected to said ball adjacent another end, said piston having at least one seal between said ends that are opposed and said piston movable in a piston bore in said housing, said piston bore comprising a first end that is exposed to pressure in said passage on one side of said ball and a second end sealingly isolated from said pressure in said passage on the same side of said ball;

said flow equalizer passage provides flow communication between said first and second ends of said piston bore.

11. The ball valve of claim 10, wherein:

a cage retains an upper seat and a lower seat against said ball, said seats having tubular extensions that in part define said passage and an annular space outside said passage, said annular space is in fluid communication with said second end of said piston bore.

12. The ball valve of claim 11, wherein:

said piston comprises a slide engaged to it and to said ball in an off center location so that axial movement of said shifting sleeve results in rotation of said ball within said cage.

13. The ball valve of claim 12, wherein:

said seats each comprise a seal in contact with said ball and another seal on said extension and outside said passage and in said annular space.

14. The ball valve of claim 13, wherein:

a biasing mechanism acts on at least one of said seats to enhance contact against said ball by said seals that contact said ball.

* * * * *